US005379910A

United States Patent [19]

Montgomery

[11] Patent Number: 5,379,910

[45] Date of Patent: Jan. 10, 1995

[54] APPARATUS FOR SEALING A CONTAINER AND CLOSURE

[75] Inventor: Gary V. Montgomery, Evansville, Ind.

[73] Assignee: Sunbeam Plastics Corporation, Evansville, Ind.

[21] Appl. No.: 991,595

[22] Filed: Dec. 16, 1992

[51] Int. Cl.[6] ..... B65D 53/00

[52] U.S. Cl. ..... 215/346; 215/216; 215/221; 215/341; 215/344; 220/256; 220/288; 229/125.15; 222/545; 222/566

[58] Field of Search ..... 220/254, 256, 288; 229/125.15, 125.17; 215/216, 221, 330, 321, 336, 341, 343, 344, 345, 346, 329; 222/545, 562, 566, 569

[56] References Cited

U.S. PATENT DOCUMENTS

| | | | |
|---|---|---|---|
| 3,339,773 | 9/1967 | Stull | 215/329 |
| 3,700,133 | 10/1972 | Bagguley | 215/221 |
| 3,939,788 | 2/1976 | Schneible | 215/216 X |
| 3,989,152 | 11/1976 | Julian | 215/216 |
| 4,172,533 | 10/1979 | Montgomery | 215/216 |
| 4,177,906 | 12/1979 | Von Hagel | 215/252 |
| 4,331,247 | 5/1982 | Mumford | 215/216 |
| 4,572,385 | 2/1986 | Luker | 215/216 |
| 5,020,683 | 6/1991 | Strassheimer | 215/354 |
| 5,213,223 | 5/1993 | Minnette | 215/216 |

*Primary Examiner*—Allan N. Shoap
*Assistant Examiner*—Vanessa Caretto
*Attorney, Agent, or Firm*—Gifford, Groh, Sprinkle, Patmore and Anderson

[57] ABSTRACT

A threaded closure and container arrangement having complementary annular surfaces on the closure and container which engage each other during threading and unthreading to guide the closure and container into axial alignment and to shape the relatively flexible neck opening of the container into an accurate circular shape so that complementary sealing surfaces are brought into accurate engagement with each other and so that the complementary surfaces maintain an axial force tending to maintain the closure and container in sealing relationship during at least initial unthreading movement of the closure from a fully closed position on the container 18 Claims, 1 Drawing Sheet

APPARATUS FOR SEALING A CONTAINER AND CLOSURE

BACKGROUND OF THE INVENTION

This invention relates to a threaded closure and container package and in particular to sealing means between the container and closure.

In the packaging industry, plastic containers are produced in which the threaded neck opening is not accurately sized or is out-of-round so that the closure does not property and accurately seal on its complementary sealing surface on the container. Also the closure and container may be manufactured by different entities and the dimensional tolerances may vary greatly In addition to facilitate threading of the closure relative to the container, ample thread tolerances are used which result in axial and radial displacement sufficient to cause misalignment of sealing surfaces. All of these variables and dimensional tolerances make it difficult to insure a good seal.

In the case of child resistant closures in which a lock interferes with the unthreading operation of the closure relative to the container a certain amount of rotation is permitted between the fully closed position and the position at which the locks engage to prevent further opening movement. This is necessary to insure orientation of the closure to one side of the lock in the fully closed position. However with the wide variance in dimensional tolerances and dimensional stability of the mating parts, it often is possible to rotate a closure in an opening direction sufficiently to break the seal before the child resistant lock engages to prevent further rotation or opening movement. In other words, it is possible to have a condition in which a child can rotate a closure sufficiently to cause leakage without overcoming the child resistant feature. This of course is a condition which cannot be tolerated.

SUMMARY OF THE INVENTION

This invention contemplates a container and closure arrangement in which the closure can have limited axial and radial displacement relative to the container and in which the container neck or opening may not be accurately formed into a perfect circle. Such deficiencies are accommodated by complementary flanges on the container neck and on the closure which interfere with each other during the threading operation so that the relatively rigid closure sizes and forms the relatively flexible container neck to bring it into accurate circular shape and the closure and container neck into axial alignment so that complementary sealing surfaces on the closure and container mate with each other.

Furthermore, the interfering flanges have complementary beveled surfaces which press against each other so that an axial component of force urges the closure in a closing direction relative to the container over a predetermined arc of rotation between the closure and container so that complementary sealing surfaces are maintained in alignment as well as in engagement with each other through a range of rotation through the predetermined arc.

DETAILED DESCRIPTION

Figure 1:
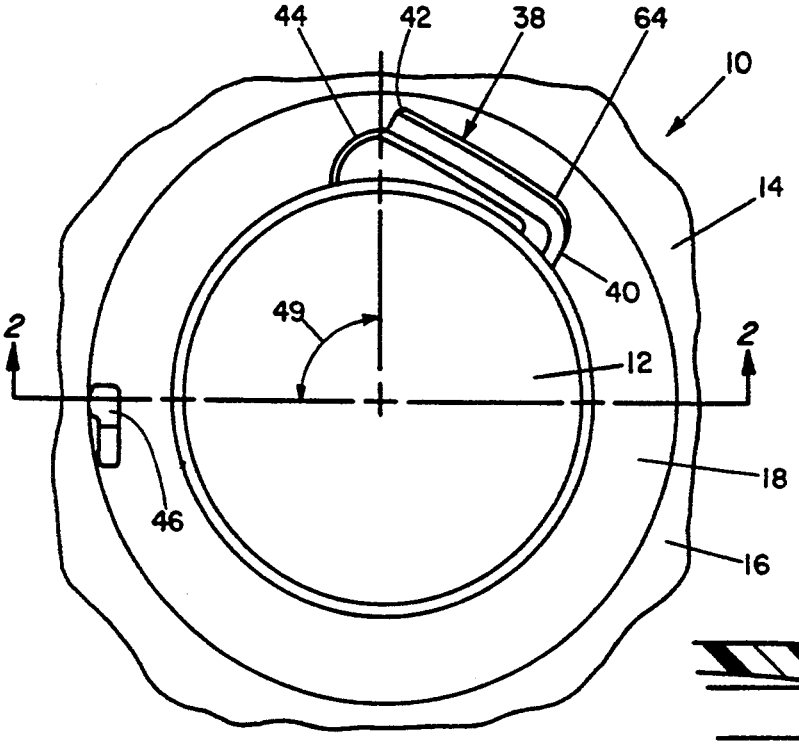
FIG. 1 is a top view of a closure on a container with portions of the container broken away.

Referring to the drawings the invention is embodied in a package 10, including a closure, designated generally at 12 and a container designated at 14. The container 14 includes a metal container portion 16 and a plastic fitment 18 which forms the dispensing opening and neck of the container 14.

The fitment 18 has an annular neck portion 20 which forms an opening 24 giving access to the interior of the container 14.

The opening 24 can be closed by a detachable threaded closure 12 which has a generally disk shaped top 26 and a depending annular skirt 28. The interior of the annular skirt 28 is provided with threads 30 which are complementary to external threads 32 on the exterior surface of the annular neck 20. The complementary threads 30 and 32 permit threaded engagement for application and removal of the closure 12 to the container 14. The threads 30 and 32 are spaced apart sufficiently to afford easy threading and unthreading and as a consequence the closure and container neck can be displaced a limited amount both axially and radially relative to each other.

Figure 3:
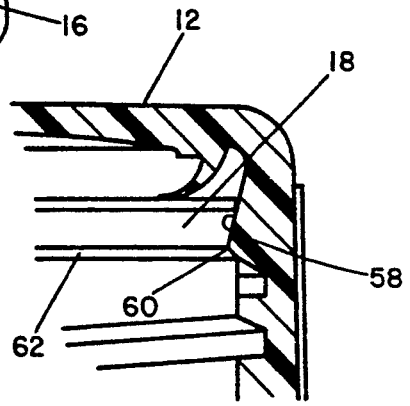
FIG. 3 is a view at an enlarged scale of the portion of the closure in the section and of the container in plan in the circled area designated at 3 in FIG. 2 and illustrating the sealing between the closure and container.
Figure 2:
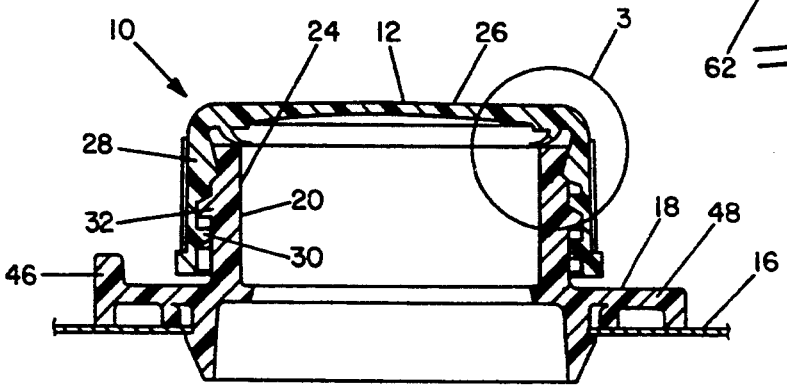
FIG. 2 is a sectional view taken on the line 2—2 in FIG. 1.
Figure 5:
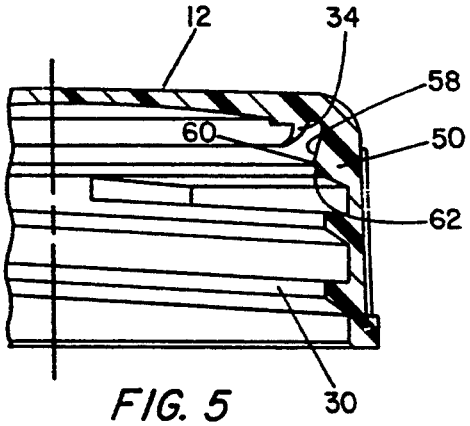
FIG. 5 is a cross sectional view of the closure with parts broken away showing the closure removed from the container.

In the closed position of the package 10, with the closure 12 applied to the container 14 as seen in FIG. 2, the opening 24 is sealed by means of an annular seal 34. As seen in FIG. 5, the closure is separate from the container and the annular seal 34 is in its, relaxed, as-molded condition. The annular seal can be formed integrally with the disc top 26 of the closure 12. When the closure 12 is applied to the container 14 to its fully closed position, the seal 34 is deflected, as shown in FIG. 3. against the lip surface 36 of the neck 20 surrounding the opening 24 to form a tight seal.

Referring now to FIG. 1, the package 10 is provided with a child proof latching arrangement in the form of a deflectable lock element 38 which has an end portion 40 molded integrally with the closure 12. The opposite end 42 of lock element 38 is deflectable radially inwardly toward the annular skirt 28 of the closure 12. Radial outward movement of the lock 38 is limited by a thong 44 molded integrally with the deflectable end 42, the lock element 38 and with the exterior of the annular skirt 28 of the closure 12. In its as-molded condition illustrated in FIG. 1, the lock element 38 and more particularly, the deflectable end 42 will engage a stop element 46 formed integrally with a radial flange 48 extending from a bottom portion of the annular neck 20 to prevent rotation in an opening direction. This feature acts to make the closure child resistant since additional manipulation is required to open the container.

To rotate the closure 12 beyond the position in which the end 42 of lock element 38 engages stop 46, it is necessary to deflect the lock element 38 radially inwardly so that the end 42 can pass radially inwardly of the stop 46. To insure that the lock element 38 is located clockwise from the stop element 46 in the fully closed position of the closure 12 on the container 14, it is necessary to make sufficient allowance and as illustrated in FIG. 1 the lock element 38 may be displaced at an angle indicated at 49 which could be as much as about 90 from the stop 46 in the closed position of the container. Rotation of the closure 12 in an opening direction or counter clockwise from a fully closed position would be permitted through the angle indicated at 49, until the lock element 38 and stop 46 come into engagement with each other. During such rotation it is important that the closure 12 remains in sealing engagement with the container 14 which requires proper axial alignment of the closure and container.

To maintain the closure 12 in axial alignment or concentric relationship with the annular neck 20, the closure and container are provided with centering and sizing means in the form of an annular flange 50 on the closure 12 and an annular flange 52 on the annular neck 20 of the container 14. The closure flange 50 and container flange 52 are located above the inside threads 30 and outside threads 22, respectively.

Figure 4:
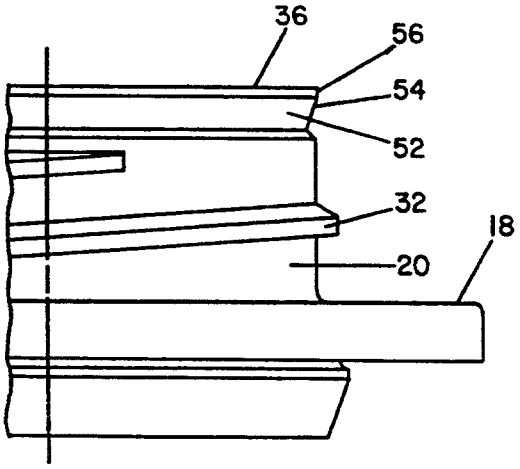
FIG. 4 is a view in elevation with portions broken away of the container neck portion.

As best seen in FIG. 4 the annular neck flange 52 has a tapered or bevel ed surface 54 extending radially inwardly and downwardly from an outside apex 56. The flange 52 is located immediately adjacent to the sealing lip surface 36 defining the opening 24 in the annular neck 20.

Referring to FIG. 5, the closure 12 has an annular flange 50 formed on the inside surface of the annular skirt 28 in close proximity to the disc shaped top 26. The annular closure flange 50 has a tapered or beveled upper surface 58 which extends radially outwardly and upwardly from an inside apex 60. The diameter of the inside apex 60 is slightly less than the outside diameter of the outside apex 56 formed on the container. Immediately below the inside apex 60 is a guide surface 62 which extends at an angle extending downwardly and radially outwardly It will be noted that the flange 50 is positioned closely adjacent the juncture of the disc shaped top 26 and annular skirt 28 of the closure 12. In this location the flange 50 is positioned in proximity to the most rigid portion of the closure structure and also in close proximity to the annular seal 34.

The outside apex 56 of container neck 20 has a diameter approximately equal to the outside wall diameter of the neck This insures that the outside apex 56 will be less than the inside diameter of the tips of the teeth 30 forming the threads on the closure so that the apex 56 does not interfere with the application the closure 12 to the container 14.

The angle of the complementary beveled sealing surfaces 54 and 58 on the closure flange 50 and container flange 52 can be approximately 15 degrees to the axes of the closure 12 and container neck 20.

During application of the closure 12 to the container neck 20 the inside threads 30 on the closure 12 can pass over the outside apex 56 of the flange 52 so that the threads 30 can come into engagement with the complementary mating threads 32 on the neck 20. When the threads 30 and 32 first engage each other threading of the closure 12 in a closing direction or clockwise as viewed in FIG. 1 will cause the lock element 38 to pass over the top of stop 46. As closing rotation continues, closure 12 moves axially downwardly relative to the neck 20 the guide surface 62 of the flange 50 comes into engagement with the outside apex 56 of the container flange 52. The flange 52 usually is relatively flexible compared to the closure 12 and as threaded rotation of the closure 12 relative to the container neck 20 continues the closure forces the container into a substantially circular sealing surface for engagement with the annular seal 34.

Continued threading causes downward axial movement which causes the inside apex 60 of closure 12 to snap over the outside apex 56 of the container 14 so that the tapered surfaces 54 and 58 are pressed together. Rotation of the closure 12 can be continued during which time a cam surface 64 on the lock element 38 comes into contact with the stop 46 causing the lock element 38 to be deflected radially inwardly to pass inside the lock element 46. Thereafter, rotation of closure 12 can continue an additional amount until it reaches its fully closed position as illustrated in FIG. 1. In the fully closed position the closure 12 can be spaced from the lock element 46 by a substantial angle as indicated at 49. However if the closure 12 is rotated in an opening direction, the lock 38 prevents rotation beyond the stop 46. At that point the complementary tapered surfaces 54 and 58 remain in engagement with each other so that an axial component of the force resulting from the pressure between the closure and the container surfaces exerts a downward force maintaining the seal 34 in sealing engagement with the sealing lip 36.

Even after the lock element 38 is deflected to bypass the stop 46 the closure 12 remains in sealing engagement with the neck 20 until the complementary surfaces 54 and 58 disengage from each other. This occurs when the inside apex 60 passes upwardly over the outside apex 56. Thereafter, unthreading can continue until the seal 34 completely disengages from the sealing lip and the threads 30 and 32 are disengaged from each other for complete removal of the closure 12 from the neck 20 of the container 14.

A container closure package has been provided in which complementary surfaces on the closure and container engage each other in the closing phase to insure axial alignment and to form the container lip into an accurate circular sealing surface to insure proper mating of the closure and container sealing surfaces. The complementary surfaces are formed at an angle to each other such that an axial force urges the closure in a closing direction even when the closure is rotated in an opening direction from a fully closed position.

I claim:

1. A package including a container and closure, comprising;

a container having a deformable neck with an opening defining a substantially annular first sealing surface and having closure receiving threads on said neck, a closure having an annular second sealing surface and inner threads complementary to said closure receiving threads, said threads being engageable with each other to permit axial and radial movement of said closure relative to said container, and centering and sizing means on said closure and said container including first and second radially extending annular flanges on said closure and container, respectively, said flanges being spaced from said sealing surfaces, each of said flanges having an apex engageable with each other upon threading of said closure on said container to force said substantially annular first sealing surface on said container into an accurate circular sealing surface for sealing engagement with said annular second sealing surface on said closure, said flanges at a lowermost point thereof each extending upwardly and radially outwardly.

2. The combination of claim 1 wherein said flanges remain engaged with each other in a closed condition of said package.

3. The combination of claim 1 wherein said first annular flange on said closure is disposed above said inner threads.

4. The combination of claim 1 wherein said annular flange on said container is disposed above said threads and adjacent to said opening in said neck.

5. The combination of claim 1 wherein said closure includes a top and an annular skirt depending from said top, said first annular flange being disposed above said threads and adjacent to said top.

6. The combination of claim 1 wherein said flanges have complementary beveled surfaces in engagement with each other in a closed condition of said closure on said container.

7. The combination of claim 6 wherein said flanges exert an axial force tending to maintain said closure in sealing engagement with said container.

8. The combination of claim 7 wherein said sealing engagement is maintained during initial engagement of said closure from a fully closed position.

9. The combination of claim 8 wherein said closure and container have complementary lock means requiring disengagement to permit engaged movement of said closure beyond a predetermined point and wherein said sealing engagement is maintained upon rotation of said closure between a fully closed position and said predetermined point.

10. The combination of claim 1 wherein said flange on said closure has a guide surface in engagement with said flange on said container upon threading of said closure onto said container.

11. The combination of claim 1 wherein said closure has a top and an annular skirt depending from said top and wherein said flange on said closure is formed on said skirt adjacent said top to maintain said flange in a relatively rigid and accurate circular shape.

12. A package including a container and a closure, said container having a neck with an opening defined by an annular first sealing surface and having closure receiving threads on said neck, an annular neck flange formed integrally with said neck above said threads and below said annular first sealing surface, said neck flange having a tapered surface extending radially inwardly and downwardly from an outside apex having a predetermined outside diameter, said closure having a top and inner threads complementary to said closure receiving threads, an annular closure flange formed integrally with said closure above said threads, said closure flange having a tapered upper surface extending radially outwardly and upwardly from an inside apex having an inside diameter and a lower guide surface extending radially outwardly and downwardly from said inside apex, an annular second sealing surface formed on said closure and being complementary to said first sealing surface on said container adjacent to said flanges, said lower guide surface on said closure flange being engaged with said outside apex of said neck flange upon axial movement of said closure relative to said container during threading in a closing direction for said closure flange to force said container flange and said annular sealing surface into an accurate circular shape and to guide said inside apex of said closure flange over said outside apex of said container flange to bring said tapered surfaces into engagement with each other to apply an axially downward force on said closure to maintain said first and second sealing surfaces in alignment and in engagement with each other in a closed condition and during initial rotation of said closure in an opening direction.

13. The combination of claim 12 wherein said closure has a top and an annular skirt depending from said top, said inner threads being formed on said skirt.

14. The combination of claim 13 wherein said annular closure flange is formed on said skirt adjacent to said top.

15. The combination of claim 12 wherein said annular sealing surface on said closure is formed on said top adjacent to said annular closure flange.

16. A package including a container and closure, comprising:

a container having a deformable neck with an opening defining a substantially annular sealing surface and having closure receiving threads on said neck, a closure having inner threads complementary to said container threads, said threads being engageable with each other to permit limited axial and radial movement of said closure relative to said container, sealing means on said closure engageable with said annular sealing surface on said container and remaining engaged with said container during rotation of said closure relative to said container through a predetermined arc, and centering and sizing means on said closure and said container including first and second annular flanges on said closure and container, respectively, having complementary beveled surfaces engageable with each other in axially spaced adjacent relation to said sealing surfaces upon threading of said closure on said container to force said substantially annular sealing surface on said container into an accurate circular sealing surface for engagement with said sealing means on said closure, said beveled surfaces remaining tightly engaged with each other and said container flange exerting an axially downward force on said closure to maintain said sealing means on said closure engaged with said container during rotation of said closure through said predetermined arc.

17. The combination of claim 16 wherein said annular flange on said container is disposed above said threads and adjacent to said opening in said neck.

18. The combination of claim 16 wherein said closure includes a top and an annular skirt depending from said top, said first annular flange being disposed above said threads and adjacent to said top.

* * * * *